US006583704B2

(12) United States Patent
Iida et al.

(10) Patent No.: US 6,583,704 B2
(45) Date of Patent: Jun. 24, 2003

(54) VARIABLE INDUCTOR

(75) Inventors: Naoki Iida, Sabae (JP); Masahiko Kawaguchi, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/828,097

(22) Filed: Apr. 6, 2001

(65) Prior Publication Data

US 2001/0028292 A1 Oct. 11, 2001

(30) Foreign Application Priority Data

Apr. 6, 2000 (JP) ..... 2000-104790

(51) Int. Cl.[7] ..... H01F 5/00
(52) U.S. Cl. ..... 336/200; 336/83; 257/531
(58) Field of Search ..... 336/83, 200, 223, 336/232, 137; 257/531

(56) References Cited

U.S. PATENT DOCUMENTS 4,035,695 A * 7/1977 Knutson et al. ..... 336/200
6,114,938 A * 9/2000 Iida et al. ..... 336/200
6,369,684 B1 * 7/2002 Iida et al. ..... 336/200

FOREIGN PATENT DOCUMENTS

| | | | |
|---|---|---|---|
| EP | 0917162 | A2 | 11/1998 |
| EP | 1113463 | A1 | 12/2000 |
| GB | 1470695 | A | 4/1977 |
| JP | 2000-223317 | A | 8/2000 |

* cited by examiner

*Primary Examiner*—Tuyen T. Nguyen
(74) *Attorney, Agent, or Firm*—Keating & Bennett, LLP

(57) ABSTRACT

A variable inductor includes an input external electrode, an output external electrode, and a coil formed by electrically connecting at least two spiral coil pattern portions in series between the input external electrode and the output external electrode. At least one trimming electrode is further provided in each of the spiral coil pattern portions. A first end and a second end of each trimming electrode are connected to the spiral coil pattern portion, and a lead out electrode, respectively, so that the trimming electrode bridges between the lead out electrode and the coil. The trimming electrodes are sequentially trimmed one-by-one, by, for example, irradiating a laser beam, starting from a trimming electrode closer to an edge, whereby the inductance of the coil is increased accordingly.

10 Claims, 5 Drawing Sheets

VARIABLE INDUCTOR

BACKGROUND OF THE INVENTION

1. Field of the Invention

The present invention generally relates to variable inductors, and more particularly, to a variable inductor for use in mobile communication devices.

2. Description of the Related Art

Electronic devices that are desired to be compact, in particular, mobile communication devices such as cellular telephones and automobile telephones, require compact components incorporated therein. Furthermore, as the frequency of operation of a device increases, the circuit becomes more complicated, and narrow variation and strict tolerance are required for the components incorporated therein. In effect, however, each component has the variation, and a circuit on which such components are merely mounted may not be correctly operated. In order to avoid such problems, methods have been conceived in which variable components are used for some of the components constituting the circuit, such that the variable components are finely adjusted to correctly operate the circuit. One method is to use variable inductors and one such conventional inductor has an inductance adjustment portion (trimming pattern portion).

FIG. 8 is a perspective view of an exemplary variable inductor 1 having an inductance adjustment portion. The variable inductor 1 includes a spiral coil 3 disposed on the surface of an insulating substrate 2. The inductance adjustment portion includes a plurality of trimming electrodes 4 which are arranged in a ladder configuration, and is located in a region defined by the coil 3. One end 3*a* of the coil 3 is electrically connected to an external electrode 7, and the other end 3*b* extends across an insulator film 5 and is electrically connected to an external electrode 8. The trimming electrodes 4 are sequentially trimmed one-by-one by irradiating a laser beam from above the variable inductor 1, so that the inductance between the external electrode 7 and the external electrode 8 may be finely adjusted in a stepwise manner.

FIG. 9 is a perspective view of another conventional variable inductor 11. The inductor 11 includes a spiral coil 13 disposed on the surface of an insulating substrate 12. An inductance adjustment portion includes trimming electrodes 14*a* to 14*d*, and the trimming electrodes 14*a* to 14*d* are extended halfway from the coil 13 to the outside of a region defined by the coil 13. The trimming electrodes 14*c* and 14*d* are located on insulator films 15*a* and 15*b* , respectively. One end 13*a* of the coil 13 is electrically connected to an external electrode 17, and the other end 13*b* extends across an insulator film 15*c* and is electrically connected to an external electrode 18. The trimming electrodes 14*a* to 14*d* are sequentially trimmed one-by-one so that the inductance between the external electrode 17 and the external electrode 18 may be adjusted.

However, the variable inductor 1 shown in FIG. 8 has a small area where the inductance adjustment portion is disposed, thus providing a small variable range for the inductance, making it difficult to acquire a variable inductance range required for a circuit adjustment. This is because increasing the area where the inductance adjustment portion is disposed in order to obtain a required variable range prevents compactness of the inductor. Furthermore, the variable inductor 1 is designed so that the electrodes 4 are arranged in a region defined by the coil 3, and the electrodes 4 become obstacles to a magnetic field generated by the coil 3. As a result, a problem occurs that the Q factor of the inductor 1 is reduced.

In the variable inductor 11 shown in FIG. 9, on the other hand, the inductance is adjusted per turn, and the inductance is not finely adjusted. Hence, even if the variable inductor includes the optimum inductance for a circuit adjustment within the variable range thereof, there was a case where the optimum value could not be obtained. In addition, the variable inductor 11 makes it difficult to connect the trimming electrodes 14*a* to 14*d* at a substantially uniform interval of coil length, resulting in difficulty in accurately adjusting the inductance in a stepwise manner by a substantially constant value. Furthermore, since the trimming electrodes 14*a* to 14*d* are not arranged in a row in the trimming order, the trimming operation is cumbersome and is not suitable for mass production.

SUMMARY OF THE INVENTION

In order to overcome the problems described above, preferred embodiments of the present invention provide a variable inductor having a high Q factor and a wide variable range of inductance which can be finely adjusted with ease.

To this end, according to a preferred embodiment of the present invention, a variable inductor includes an input external electrode and an output external electrode, a coil defined by electrically connecting at least two spiral coil pattern portions in series between the input external electrode and the output external electrode, at least one trimming electrode provided in each of the at least two spiral coil pattern portions, each trimming electrode having one end connected to the spiral coil pattern portion, and a lead out electrode connected to the other end of each trimming electrode, wherein the lead out electrode is connected to one of the input external electrode and the output external electrode.

Preferably, the trimming electrodes are arranged in a row and are connected to the spiral coil pattern portions, such that the trimming electrodes are sequentially cut starting from a trimming electrode at an end, whereby the inductance of the coil is increased accordingly.

Accordingly, at least two spiral coil pattern portions are electrically connected in series between the input external electrode and the output external electrode to define a coil, where the trimming electrodes may be arranged in the trimming order. This facilitates the trimming operation, and avoids such an inconvenience as erroneous cutting during the trimming, thereby providing more reliable trimming. This further allows for a wider variable inductance range required for a circuit adjustment. The trimming electrodes are sequentially trimmed (cut) one-by-one so that the inductance of the coil may be finely adjusted in a stepwise manner by a constant value.

Other features, elements, characteristics and advantages of the present invention will become more apparent from the following detailed description of preferred embodiments with reference to the attached drawings.

BRIEF DESCRIPTION OF THE DRAWINGS

Some illustrative preferred embodiments of a variable inductor according to the present invention will be described with reference to the accompanying drawings in conjunction with the following detailed description, in which.

DETAILED DESCRIPTION OF PREFERRED EMBODIMENTS

Figure 1:
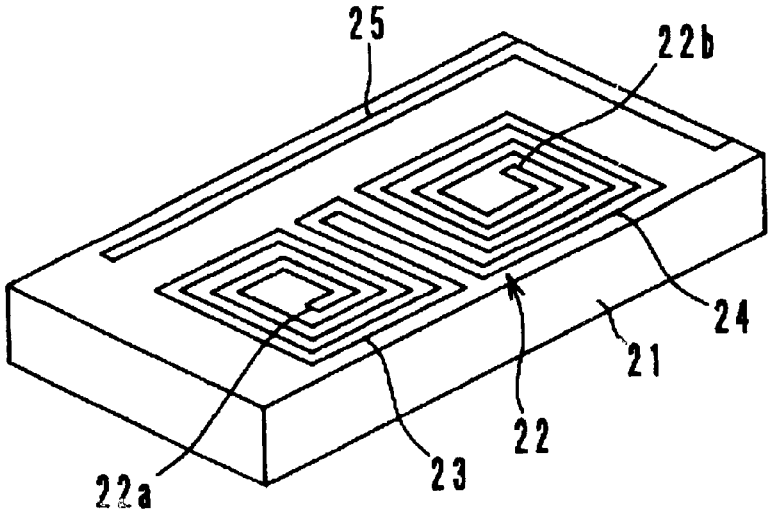
FIG. 1 is a perspective view of a variable inductor according to a preferred embodiment of the present invention.

Referring to FIG. 1, a coil 22 and a lead out electrode 25 are provided on the upper surface of an insulating substrate 21, which has been polished to be smooth, by thick-film printing or thin-film formation such as sputtering and deposition, or other suitable process.

Thick-film printing is a technique which includes providing a screen, for example, having openings in a desired pattern, over the upper surface of the insulating substrate 21, and applying a conductive paste onto the screen to form relatively thick conductors (the coil 22 and the lead out electrode 25 in the present preferred embodiment) in a desired pattern on portions of the upper surface of the insulating substrate 21 which are exposed from the openings in the screen.

Thin-film formation may include a technique described below. A relatively thin conductive film is formed on substantially the overall upper surface of the insulating substrate 21, and a resist film such as a photosensitive resin film is then formed on substantially the overall conductive film by spin-coating or printing. A mask film having a predetermined image pattern overlays the upper surface of the resist film, and a desired portion of the resist film is then cured such as by exposing it to ultraviolet rays. The resist film is peeled off with the cured portion being left, and the exposed portion of the conductive film is removed to form a conductor (the coil 22 and the lead out electrode 25 in the present preferred embodiment) in the desired pattern. Thereafter, the cured resist film is then removed.

Another possible formation process may involve a technique which includes applying a photosensitive conductive paste onto the upper surface of the insulating substrate 21, and covering it with a mask film having a predetermined image pattern, followed by exposure and development.

The coil 22 is preferably formed by electrically connecting two spiral coil pattern portions 23 and 24 in series. The coil pattern portions 23 and 24 are arranged side-by-side in the longitudinal direction of the insulating substrate 21. One end of the lead out electrode 25 is exposed on the right side of the insulating substrate 21, as viewed in FIG. 1. The materials of the insulating substrate 21 preferably include glass, glass ceramic, alumina, ferrite, Si, and $SiO_2$. The materials of the coil 22 and the lead out electrode 25 preferably include Ag, Ag—Pd, Cu, Ni, and Al.

Figure 2:
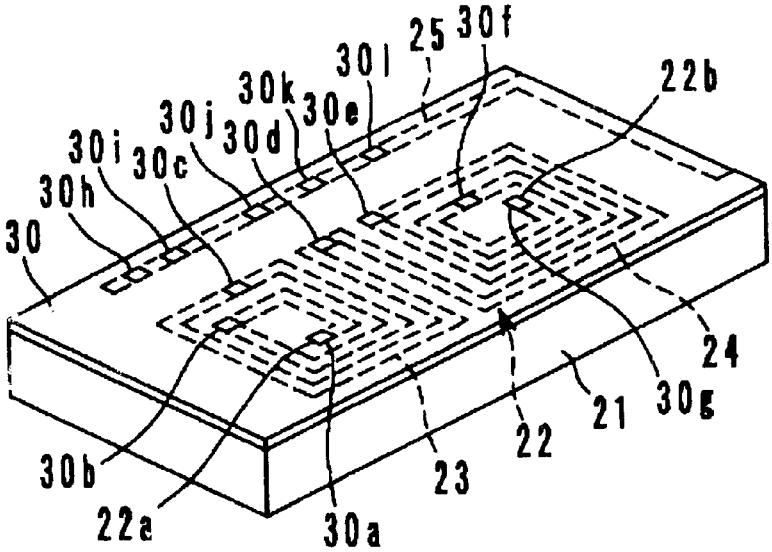
FIG. 2 is a perspective view of the variable inductor which is manufactured during a manufacturing procedure.

Turning now to FIG. 2, an insulating protection film 30 having openings 30*a* to 301 is preferably formed. Specifically, liquid insulating material is preferably coated on the entire upper surface of the insulating substrate 21 by spin-coating or printing, and is dried and fired to form the insulating protection film 30. The insulating materials used herein include photosensitive polyimide resin, and photosensitive glass paste. Then, a mask film having a predetermined image pattern overlays the upper surface of the insulating protection film 30, and the desired portion of the insulating protection film 30 is cured by, for example, exposing it to ultraviolet rays. The uncured portion of the insulating protection film 30 is then removed so that the openings 30*a* to 301 may appear. Exposed in the opening 30*a* is one end 22*a* of the coil 22 which is positioned inside of the spiral coil pattern portion 23. The other end 22*b* of the coil 22 which is positioned inside of the spiral coil pattern portion 24 is exposed at the opening 30*g*. In turn, predetermined portions of the coil 22 are exposed in the openings 30*b* to 30*f*, and predetermined portions of the lead out electrode 25 are exposed in the openings 30*h* to 301.

Figure 3:
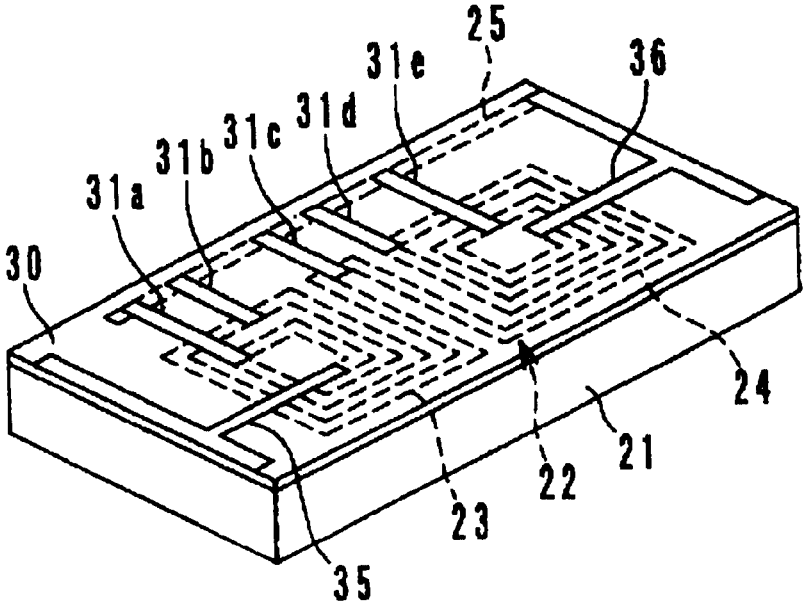
FIG. 3 is a perspective view of the variable conductor element which is fabricated during a manufacturing procedure.

Turning now to FIG. 3, trimming electrodes 31*a* to 31*e*, and lead out electrodes 35 and 36 are preferably formed by thick-film printing or thin-film formation such as sputtering and deposition, as is similar to the case of forming the coil 22. The lead out electrode 35 is electrically connected to the end 22*a* of the coil 22 via the opening 30*a* in the insulating protection film 30. The lead out electrode 36 is electrically connected to the end 22*b* of the coil 22 via the opening 30*g*. Likewise, first ends of the trimming electrodes 31*a* to 31*e* are electrically connected to the predetermined portions of the coil 22 via the openings 30*b* to 30*f* in the insulating protection film 30, respectively. Second ends of the trimming electrodes 31*a* to 31*e* are electrically connected to the predetermined portions of the lead out electrode 25 via the openings 30*h* to 301, respectively.

As viewed in FIG. 3, the trimming electrodes 31*a* to 31*e* are arranged in a row in a ladder configuration at the rear of the insulating substrate 21, i.e., are arranged at a side of the coil 22, so as to bridge between the lead out electrode 25 and the coil 22. The lead out electrode 35 is exposed on the left side of the insulating substrate 21, while the lead out electrode 36 is exposed on the right side of the insulating substrate 21.

Figure 4:
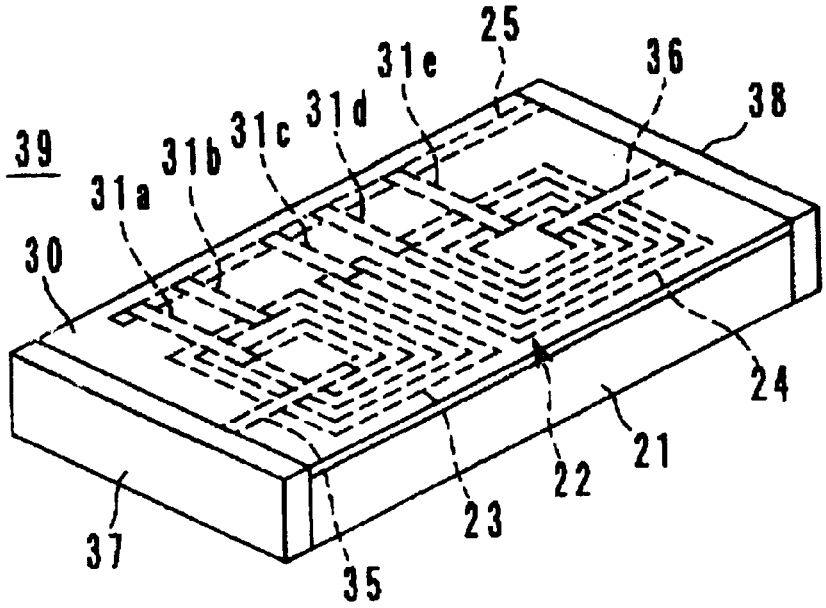
FIG. 4 is a perspective view of an external appearance of the resultant variable inductor according to a preferred embodiment of the present invention.

As shown in FIG. 4, liquid insulating material is coated on the overall upper surface of the insulating substrate 21 by spin-coating or printing, and the result is dried and fired, so that the insulating protection film 30 overlays the trimming electrodes 31*a* to 31*e* and the lead out electrodes 35 and 36. Then, external electrodes 37 and 38 are formed on the ends of the insulating substrate 21 so as to extend in the longitudinal direction. The external electrode 37 is electrically connected to the lead out electrode 35, and the external electrode 38 is electrically connected to the lead out electrodes 25 and 36. The external electrodes 37 and 38 are formed preferably by applying conductive paste made of Ag, Ag—Pd, Cu, NiCr, NiCu, Ni, or other suitable material, and firing the result, followed by wet type electrolytic plating to form metal films made of Ni, Sn, Sn—Pb, or other suitable material. The external electrodes 37 and 38 may be otherwise formed by sputtering or deposition or other suitable process.

The resulting variable inductor 39 includes a circuit in which the coil 22 and the inductance adjustment portion (the trimming electrodes 31*a* to 31*e* ) are electrically connected on the insulating substrate 21. Since only a fraction of the trimming electrodes 31*a* to 31*e* is disposed in the region defined by the coil 22 on the substrate 21, the magnetic field generated by the coil 22 is less blocked by the trimming electrodes 31*a* to 31*e*. Therefore, the inductor 39 has a very high Q.

Figure 5:
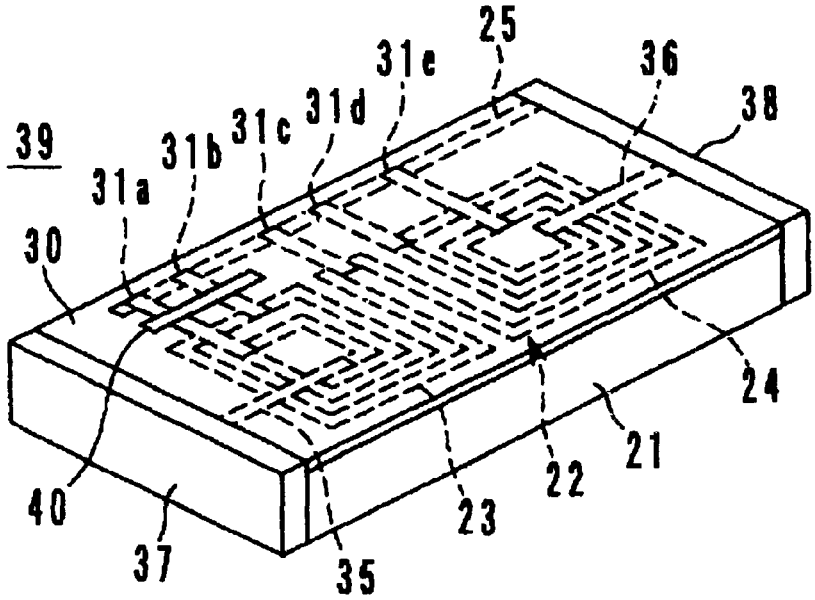
FIG. 5 is a perspective view illustrating that some of the trimming electrodes are trimmed so that the inductance of the variable inductor shown in FIG. 4 may be adjusted.

After the variable inductor 39 is mounted on a printed board or other suitable substrate, the trimming electrodes 31*a* to 31*e* are trimmed, for example, irradiating a laser beam from above the variable inductor 39, as shown in FIG. 5, and thus, a trimming groove 40 is formed in the variable inductor 39. The trimming electrodes 31*a* to 31*e* are sequentially cut one-by-one in the order starting from the trimming electrode 31*a* located at an end, and so on. It will be noted that FIG. 5 illustrates that the two trimming electrodes 31*a* and 31*b* are cut. Therefore, the inductance between the external electrodes 37 and 38 can be increased little by little in a stepwise manner by a constant value.

Figure 6:
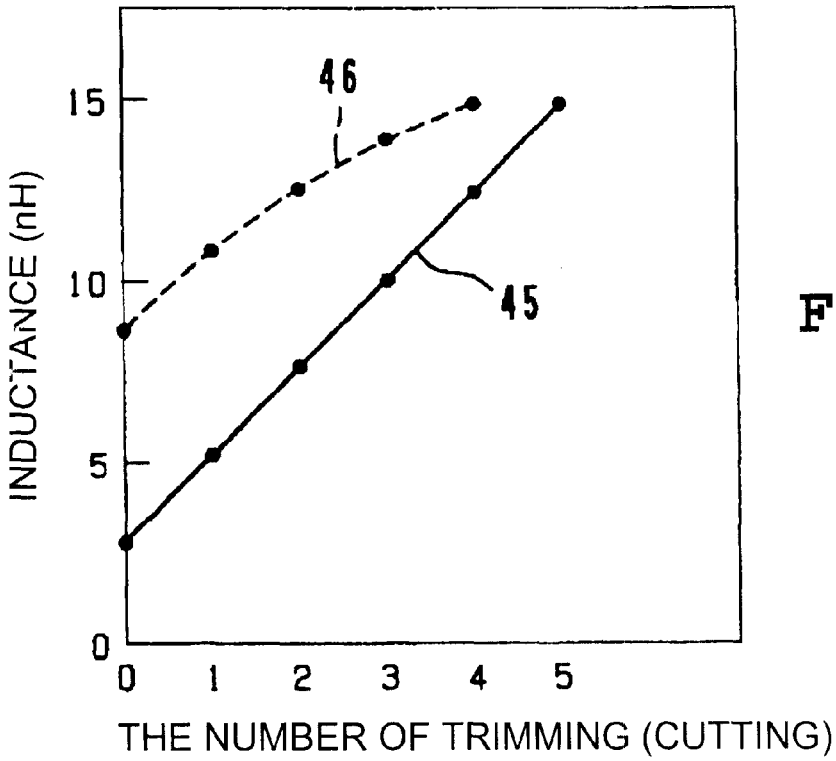
FIG. 6 is a graph showing a variable inductance range of the variable inductor shown in FIG. 4.
Figure 9:
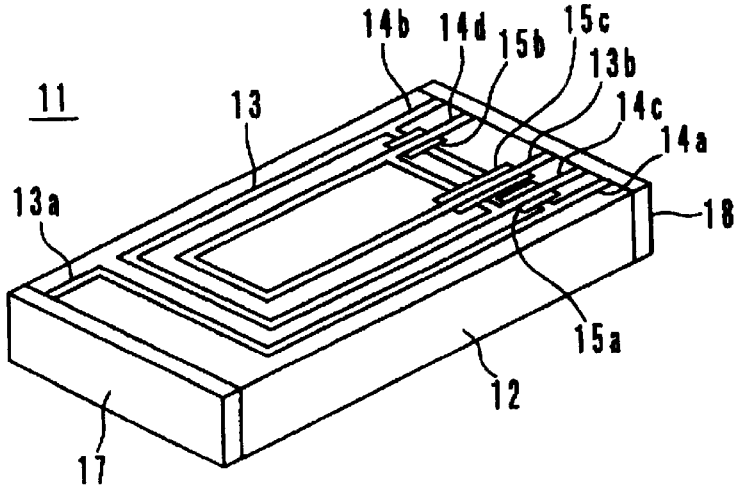
FIG.9 PRIOR ART
FIG. 9 is a perspective view of another conventional inductor.

FIG. 6 is a graph showing the result of measurement on a change in inductance with respect to the variable inductor 39 having approximate dimensions of 2.0 mm×1.25 mm, as indicated by solid line 45. For comparison, in FIG. 6, the result of measurement on the conventional variable inductor 11 shown in FIG. 9 is indicated by dotted line 46. The variable inductor 39 of the present preferred embodiment has a wide variable range from a low inductance of about 3 nH to a high inductance of about 15 nH. In contrast, the conventional variable inductor 11 has a narrower variable range of a relatively high inductance from about 9 nH to about 15 nH.

Since the variable inductor 39 is provided with the coil 22 including two spiral coil pattern portions 23 and 24 to which the trimming electrodes 31*a* and 31*b*, and 31*d* and 31*e* are connected, respectively, the trimming electrodes 31*a* to 31*e* may be arranged in the trimming order, thus facilitating the trimming operation. In addition, the trimming electrodes 31*a* to 31*e* may be connected at a substantially uniform interval of coil length, allowing the inductance to be finely adjusted stepwise, namely, linearly, by a substantially constant value.

In order to more finely adjust the inductance, the number of trimming electrodes 31*a* to 31*e* may be increased. The trimming electrodes 31*a* to 31*e* can be trimmed not only by a laser beam but by any other suitable process such as sandblasting. It is sufficient for each of the trimming electrodes 31*a* to 31*e* to be electrically cut, and the trimming groove 40 does not have to have a physically recessed configuration. In particular, when the insulating protection film 30 is made of glass or glass ceramic, molten glass due to irradiation of laser beams may enter into the trimmed portions to form protection films after trimming. This prevents the trimmed electrode portions from being exposed.

The variable inductor according to the present invention is not limited to the illustrated preferred embodiments, and a variety of modifications may be made without departing from the spirit and scope of the invention.

Figure 7:
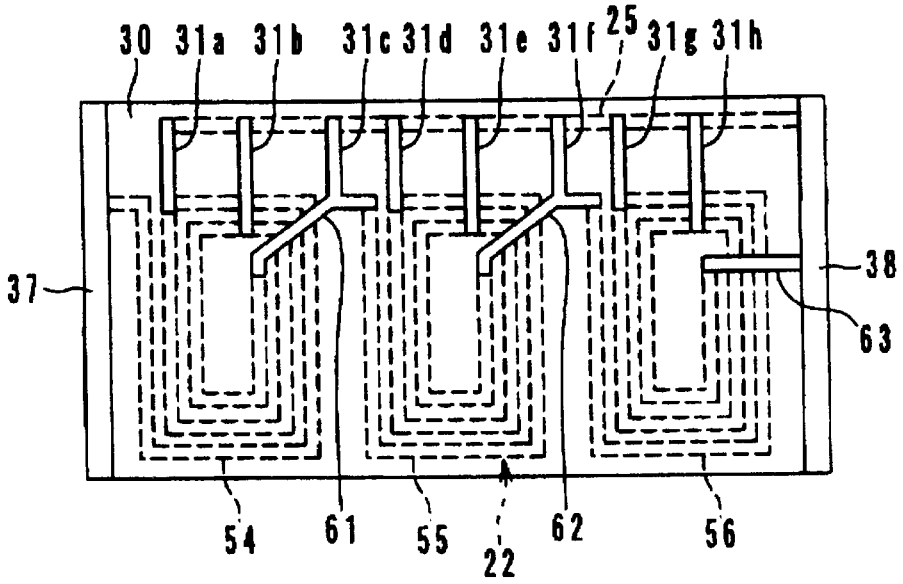
FIG. 7 is a plan view of a modification of the variable inductor according to the present invention.
Figure 8:
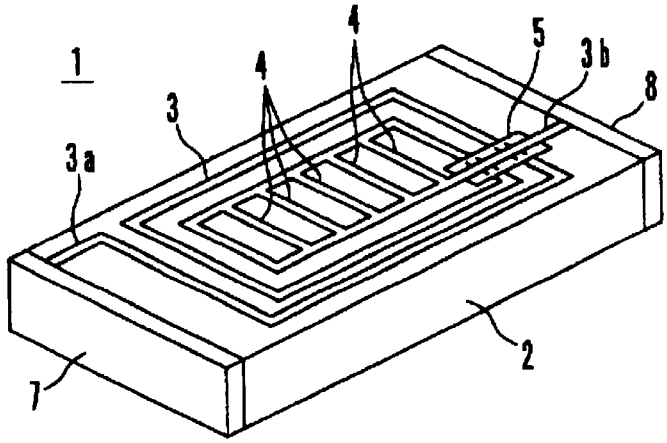
FIG.8 PRIOR ART
FIG. 8 is a perspective view of a conventional variable inductor.

Any number of spiral coil pattern portions, but more than one, which constitute a coil may be adapted, and the coil 22 may be defined by, for example, three spiral coil pattern portions 54, 55, and 56 which are electrically connected in series, as shown in FIG. 7. In FIG. 7, there are shown eight trimming electrodes 31*a* to 31*h*, and relay pattern portions 61 and 62 through which the coil pattern portions 54 to 56 are connected in series. A lead out electrode 63 is used to connect the coil 22 to the external electrode 38. Accordingly, an increased number of spiral coil pattern portions allow the inductance to be more finely adjusted.

It is not necessary to connect trimming electrodes 31*a* to 31*h* to all of the coil pattern portions 54 to 56. The trimming electrodes 31*g* and 31*h* may be omitted so that no trimming electrode is connected to the coil pattern portion 56.

The illustrated preferred embodiments have been described with respect to the case of individual production. For mass production, an effective approach involves fabricating a motherboard (wafer) having a plurality of variable inductors, and cutting the motherboard into pieces for each product dimension by techniques such as dicing, scribing and breaking, and using laser during the final stage.

The variable inductor may also be designed so that a printed board on which a circuit pattern has been formed has more than one spiral coil pattern directly disposed thereon.

While preferred embodiments have been described above, it is to be understood that modifications and changes will be apparent to those skilled in the art without departing from the spirit of the invention. The scope of the present invention is therefore to be determined solely by the appended claims.

What is claimed is:

1. A variable inductor comprising:

an input external electrode;

an output external electrode;

a coil defined by at least two spiral coil pattern portions electrically connected in series between said input external electrode and said output external electrode;

at least one trimming electrode provided in each of said at least two spiral pattern portions, each trimming electrode having a first end connected to a respective one of said at least two spiral coil pattern portions; and a lead out electrode connected to a second end of each of said trimming electrodes;

wherein said lead out electrode is connected to one of said input external electrode and said output external electrode.

2. A variable inductor according to claim 1, wherein the trimming electrodes are arranged in a row.

3. A variable inductor according to claim 2, wherein the trimming electrodes are connected to the spiral coil pattern portions, such that the trimming electrodes are arranged to be cut sequentially starting from a trimming electrode at an end so as to increase the inductance of said coil.

4. A variable inductor according to claim 1, wherein the at least two spiral coil pattern portions are arranged side-by-side.

5. A variable inductor according to claim 1, wherein the trimming electrodes are arranged in a row in a ladder configuration.

6. A variable inductor according to claim 1, wherein the trimming electrodes are arranged at a side of the coil so as to bridge between a lead out electrode and the coil.

7. A variable inductor according to claim 1, wherein the trimming electrodes define an inductance adjustment portion.

8. A variable inductor according to claim 7, wherein the coil and the inductance adjustment portion are electrically connected.

9. A variable inductor according to claim 1, wherein only a fraction of the trimming electrodes are disposed in the region defined by the coil.

10. A variable inductor according to claim 1, wherein the coil is defined by at least three coil pattern portions which are electrically connected in series.

* * * * *